US005431754A

United States Patent [19]

Fujiwara et al.

[11] Patent Number: 5,431,754

[45] Date of Patent: Jul. 11, 1995

[54] TIAL-BASED INTERMETALLIC COMPOUND WITH EXCELLENT HIGH TEMPERATURE STRENGTH

[75] Inventors: Yoshiya Fujiwara; Toshio Tokune, both of Saitama, Japan

[73] Assignee: Honda Giken Kogyo Kabushiki Kaisha, Tokyo, Japan

[21] Appl. No.: 131,884

[22] Filed: Oct. 5, 1993

[30] Foreign Application Priority Data

Oct. 5, 1992 [JP] Japan ..... 4-290800

[51] Int. Cl.[6] ..... C22C 14/00

[52] U.S. Cl. ..... 148/669; 148/421; 420/421

[58] Field of Search ..... 148/669, 421; 420/421

[56] References Cited

U.S. PATENT DOCUMENTS

| | | | |
|---|---|---|---|
| 4,661,316 | 4/1987 | Hashimoto et al. | 420/418 |
| 5,076,858 | 12/1991 | Huang | 148/670 |
| 5,190,603 | 3/1993 | Nazmy et al. | 148/671 |
| 5,196,162 | 3/1993 | Maki et al. | 420/418 |
| 5,226,985 | 7/1993 | Kim et al. | 148/669 |
| 5,232,661 | 8/1993 | Matsuo et al. | 420/421 |

FOREIGN PATENT DOCUMENTS

| | | | |
|---|---|---|---|
| 0521516 | 1/1993 | European Pat. Off. | C22C 14/00 |
| 3193837 | 8/1991 | Japan | C22C 14/00 |
| 9209712 | 6/1992 | WIPO | C22C 19/03 |

OTHER PUBLICATIONS

Hashimoto et al, (Eng. Translation) CAMP-ISIJ, vol. 3 (1990) p. 1652.

English Language Abstracts of JP 5-70869, 5-70870, 5-70873, 4-365828, 4-365829, 4-365830, 3-193850, 3-193851 & 3-193852.

Chemical Abstracts, Mar. 8, 1993—vol. 118, "Chemistry of Synthetic High Polymers".

*Primary Examiner*—Upendra Roy

*Attorney, Agent, or Firm*—Lyon & Lyon

[57] ABSTRACT

A TiAl-based intermetallic compound has a metallographic structure which includes a region A having fine β-phases dispersed in a γ-phase. The volume fraction Vf of the β-phases in the region A is set equal to or more than 0.1% (Vf≧0.1%). Thus, the β-phases can exhibit a pinning effect to prevent a transgranular pseudo cleavage fracture in the γ-phase, thereby providing an enhanced high-temperature strength of the TiAl-based intermetallic compound.

8 Claims, 9 Drawing Sheets

50μm

TIAL-BASED INTERMETALLIC COMPOUND WITH EXCELLENT HIGH TEMPERATURE STRENGTH

BACKGROUND OF THE INVENTION

1. Field of the Invention

The present invention relates to a TiAl-based intermetallic compound having an excellent high-temperature strength, and processes for producing the same.

2. Description of the Prior Art

A TiAl-based intermetallic compound is expected as a lightweight heat resistant material, and those having various structures have been conventionally proposed (for example, see U.S. Pat. No. 4,879,092 and Japanese Patent Application Laid-open Nos. 25534/90 and 193852/91).

However, even now conventional TiAl-based intermetallic compounds are not put into practical use as a heat-resistant material, because the strength thereof is insufficient for high temperatures. That is temperatures exceeding about 750° C.

SUMMARY OF THE INVENTION

Accordingly, it is an object of the present invention to provide a TiAl-based intermetallic compound of the type described above, which has a high-temperature strength enhanced by improving the metallographic structure thereof, and a process for producing the same.

To achieve the above object, according to the present invention, there is provided a TiAl-based intermetallic compound with an excellent high-temperature strength, wherein the compound has a metallographic structure which comprises a region having fine $\beta$-phases dispersed in a $\gamma$-phase, the volume fraction Vf of the $\beta$-phases in the region being equal to or more than 0.1% ($Vf \geqq 0.1\%$).

If the metallographic structure of the TiAl-based intermetallic compound is configured in the above manner, it is possible to enhance the high-temperature strength of the TiAl-based intermetallic compound. This is attributable to the fact that the fine $\beta$-phases dispersed in the $\gamma$-phase exhibit a pinning effect, thereby preventing a transgranular pseudo cleavage fracture in the $\gamma$-phase. However, if the volume fraction Vf of the $\beta$-phases is less than 0.1%, a sufficient pinning effect cannot be provided. If the $\beta$-phases are present between the adjacent regions, i.e., in the grain boundaries, a high-temperature strength enhancing effect is not provided.

In addition, according to the present invention, there is provided a process for producing a TiAl-based intermetallic compound with an excellent high-temperature strength, having a metallographic structure which comprises; a first region consisting of either a region having fine $\beta$-phases dispersed in a $\gamma$-phase, or a region consisting of $\alpha_2$-phases and fine $\beta$-phases dispersed in a $\gamma$-phase; and a second region having a $\gamma$-phase which does not include $\beta$-phase, the volume fraction Vf of $\beta$-phases in the first region being equal to or more than 0.1% ($Vf \geqq 0.1\%$); the process comprising: a first step of subjecting a TiAl-based intermetallic compound blank having a metallographic structure including a $\gamma$-phase and at least one of $\alpha_2$- and $\beta$-phases to a solution treatment at a treatment temperature set in a range which permits $\alpha$- and $\gamma$-phases to be present, thereby providing an intermediate product having a metallographic structure including $\gamma$-phases and supersaturated $\alpha_2$-phases, and a second step of subjecting the intermediate product to an artificial aging treatment at a temperature set in a range which permits $\alpha_2$- and $\gamma$-phases to be present.

In the above producing process, if the TiAl-based intermetallic compound blank is subjected to the solution treatment employing the treatment temperature and a quenching, it is possible to prevent a coalescence of $\alpha_2$- and $\gamma$-phases in the intermediate product. If the intermediate product is subjected to the artificial aging treatment at the above-described temperature, the $\gamma$-phase is precipitated in the $\alpha_2$-phase, and the fine $\beta$-phases are precipitated in a dispersed fashion in the $\gamma$-phase. Further, depending upon the treatment temperature in the solution treatment, the $\alpha_2$-phases may be dispersed together with the $\beta$-phases in the $\gamma$-phase.

The above and other objects, features and advantages of the invention will become apparent from the following description of preferred embodiments, taken in conjunction with the accompanying drawings.

DESCRIPTION OF THE PREFERRED EMBODIMENTS

Figure 1:
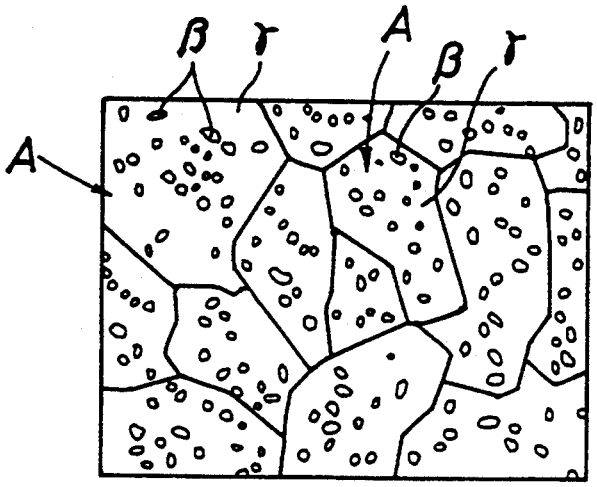
FIG. 1 is a schematic diagram illustrating one example of a metallographic structure of a TiAl-based intermetallic compound.

Referring to FIG. 1, one example of a metallographic structure of a TiAl-based intermetallic compound is illustrated in a schematic diagram. This metallographic structure is comprised of an infinite number of regions A each having fine $\beta$-phases ($\beta$-phases having B2 ordered structure) dispersed in a $\gamma$-phase (a TiAl phase). In addition to the $\beta$-phases, $\alpha_2$-Phases may be dispersed in the $\gamma$-phase in some cases.

With such a configuration, the fine $\beta$-phases dispersed in the $\gamma$-phase exhibit a pinning effect, and a transgranular pseudo cleavage fracture in the $\gamma$-phase is prevented, thereby enhancing a high-temperature strength of a TiAl-based intermetallic compound. The volume fraction Vf of the $\beta$-phases in each of the regions A is set equal to or more than 0.1% ($Vf \geqq 0.1\%$) in order to provide such effect. It should be noted that the $\alpha_2$-phases dispersed in the $\gamma$-phase do not contribute to an enhancement in high-temperature strength of the TiAl-based intermetallic compound.

Figure 2:
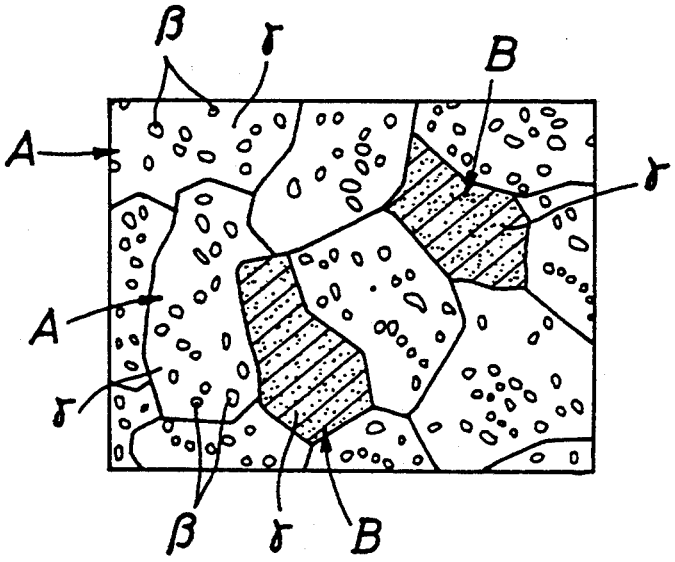
FIG. 2 is a schematic diagram illustrating another example of a metallographic structure of a TiAl-based intermetallic compound.

FIG. 2 is a schematic diagram showing another example of a metallographic structure of a TiAl-based intermetallic compound. This metallographic structure is comprised of an infinite number of first regions A each having fine $\beta$-phases dispersed in a $\gamma$-phase, and an infinite number of regions B each having a $\gamma$-phase with no $\beta$-phase included therein. In the first region A, $\alpha_2$-phases, in addition to the $\beta$-phases, may also be dispersed in the $\gamma$-phase in some cases.

Even with such a configuration, an effect similar to the above-described effect is provided because of the presence of the first regions A. In order to provide such effect, the volume fraction Vf of the $\beta$-phases in each of the regions A is set equal to or more than 0.1% ($Vf \geqq 0.1\%$), and the volume fraction Vf of the first regions A in the metallographic structure is set equal to or more than 1% ($Vf \geqq 1\%$). It should be noted that the $\gamma$-phase including no $\alpha_2$- and $\beta$-phases and thus, the second region B does not contribute to the enhancement in high-temperature strength of the metallographic structure.

A difference between the metallographic structures of the above-described types is attributable to conditions for producing the TiAl-based intermetallic compounds. For example, in producing the TiAl-based intermetallic compound having the metallographic structure shown in FIG. 2, there is employed a procedure, which comprises a first step of subjecting a TiAl-based intermetallic compound blank having a metallographic structure including a $\gamma$-phase and at least one of $\alpha_2$- and $\beta$-phases to a solution treatment at a treatment temperature which is set in a range permitting the $\alpha_2$and $\gamma$-phases to be present, thereby providing an intermediate product having a metallographic structure including the $\gamma$-phase and supersaturated $\alpha_2$-phases; and a second step of subjecting the intermediate product to an artificial aging treatment at a treatment temperature which is set in a range permitting the $\alpha_2$- and $\gamma$-phases to be present. The TiAl-based intermetallic compound blank contains aluminum in a content represented by 36 atomic % $\leqq$Al$\leqq$52 atomic % and titanium in a content represented by 48 atomic % $\leqq$Ti$\leqq$64 atomic % as well as at least one $\beta$-area enlarging element E as a third element, which is selected from the group consisting of Mo, Nb, Ta, V, Co, Cr, Cu, Fe, Mn, Ni, Pb, Si and W. The content of the $\beta$-area enlarging element E is set equal to or more than 0.5 atomic %. If the contents of aluminum, titanium and the $\beta$-area enlarging element E depart from the above-described ranges, respectively, it is not possible to produce a TiAl-based intermetallic compound blank having a metallographic structure of the type described above.

Figure 3:
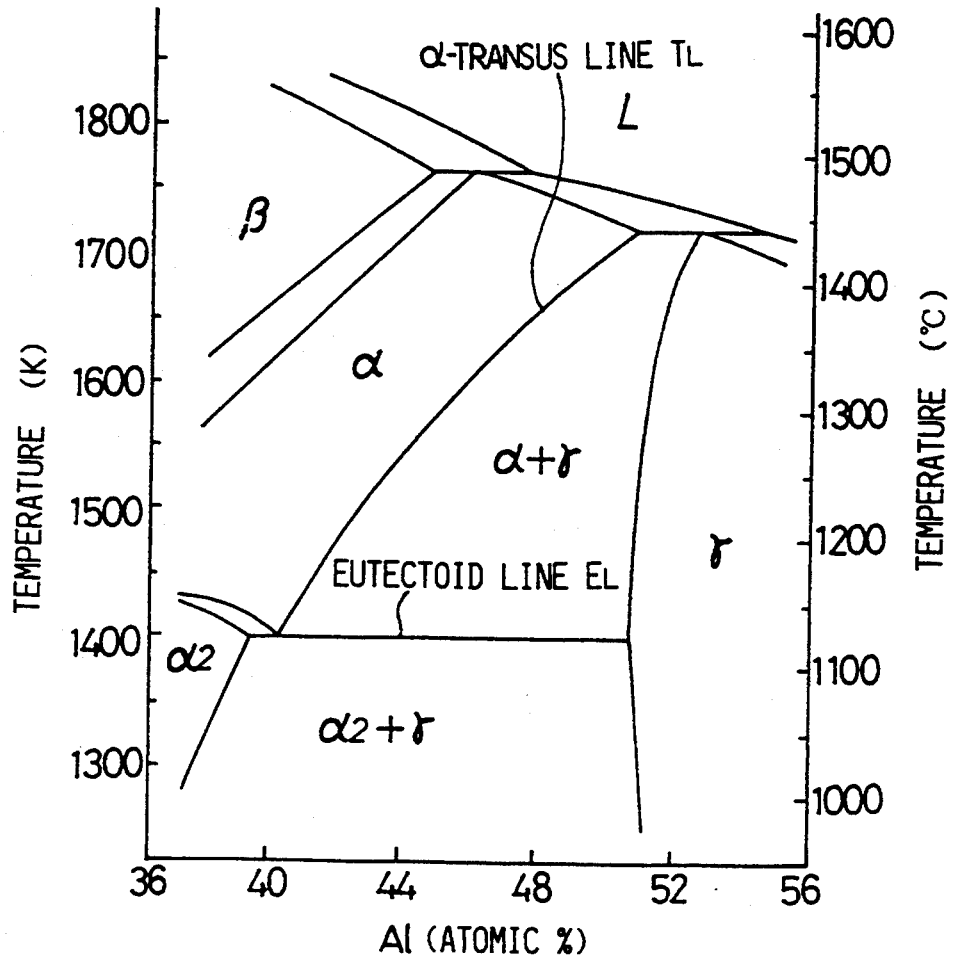
FIG. 3 is a portion of a phase diagram showing states of the TiAl-based intermetallic compound.

As shown in FIG. 3 the treatment temperature in the solution treatment is set at a range equal to or more than an eutectoid line $E_L$ which permits a reaction, $\alpha$-phase+$\gamma$-phase$\rightarrow\alpha_2$-phase+$\gamma$-phase, to occur, but is set equal to or less than $\alpha$-transus line $T_L$ which permits a reaction, $\alpha$-phase$\rightarrow\alpha$-phase+$\gamma$-phase, to occur, in a Ti-Al based phase diagram. This is for the purpose of preventing the coalescence of the $\alpha_2$- and $\gamma$-phases in the intermediate product.

The cooling rate in the solution treatment is set at a value higher than a cooling rate in an oil quenching. This is because $\gamma$-phases may be precipitated in a laminar configuration in an $\alpha_2$-phase, if the cooling rate is slower than that during an oil quenching.

The treatment temperature in the artificial aging treatment is set in a range equal to or more than 700° C., but equal to or less than the above-described eutectoid line $E_l$. In this range of temperature, fine $\beta$-phases can be precipitated in a dispersed state in the $\gamma$-phase.

The heating time in the solution treatment and the artificial aging treatment is set in a range of at least 5 minutes to ensure that these treatments are practically effective.

Particular examples will be described below.

First, a starting material was prepared by weighing an aluminum shot having a purity of 99.99%, a titanium sponge having a purity of 99.8% and a Cr-Nb alloy, so that Al was 47 atomic %; Cr was 2 atomic %; Nb was 2 atomic %, and the balance was titanium.

The starting material was melted in a plasma melting furnace to prepare about 20 kg of an ingot. Then, the ingot was subjected to a homogenizing treatment at 1200° C. for 48 hours for the purpose of homogenizing the ingot and removing casting defects. Subsequently, the ingot was subjected to a hot isostatic pressing treatment under conditions of 1200° C., 3 hours and 193 MPa. Further, the resulting material was subjected to an upsetting treatment with an upsetting rate of 80% (a high rate) at 1200° C. by a vacuum isothermal forging. The upset product obtained in this manner was cut into a plurality of TiAl-based intermetallic compound blanks. The metallographic structure of these TiAl-based intermetallic compound blanks was comprised of an infinite number of $\gamma$-phases, and $\beta$- and $\alpha_2$-phases precipitated in a grain boundary of the $\gamma$-phases. Each of the TiAl-based intermetallic compound blanks was heated for 2 hours at 1200°–1300° C. and was then subjected to a solution treatment in which a water-hardening was conducted, thereby providing an intermediate product. Each of the intermediate products has a metallographic structure having $\beta$-phases and supersaturated $\alpha_2$-phases. No $\beta$-phase was precipitated in the $\gamma$-phase.

Then, individual intermediate products were subjected to an artificial aging treatment in which they were heated for 1 to 12 hours at 900°–1200° C., thereby providing TiAl-based intermetallic compounds according to examples of the present invention and comparative examples.

Table 1 shows conditions in the solution treatment and conditions in the artificial aging treatment for the examples (1) to (3) and the comparative examples (1) and (2). The comparative example (2) is TiAl-based intermetallic compound blank.

TABLE 1

| | Solution Treatment | | Artificial Aging Treatment | |
|---|---|---|---|---|
| | Temperature (°C.) | Time (hour) | Temperature (°C.) | time (hour) |
| Example (1) | 1300 | 2 | 900 | 12 |
| Example (2) | 1200 | 2 | 900 | 8 |
| Example (3) | 1300 | 2 | 900 | 1 |
| Comparative example (1) | 1300 | 2 | 1200 | 3 |
| Comparative example (2) | — | — | — | — |

FIG. 3 shows a diagram showing states of the TiAl-based intermetallic compound in the example (1) or the like and thus the TiAl-based intermetallic compound having Cr and Nb contents set at 2 atomic %. In the examples (1) to (3), the treatment temperature in the solution treatment is set in a range equal to or more than the eutectoid line $E_L$, but equal to or less than the α-transus line $T_L$. And the treatment temperature in the artificial aging treatment is set in a range equal to or more than 700° C., but equal to or less than the eutectoid line $E_L$. In the case of the comparative example (1), the treatment temperature in the solution treatment is set in the above-described range, but the treatment temperature in the artificial aging treatment exceeds the eutectoid line $E_L$ which is the upper limit value of the above-described range.

Table 2 shows textures on the metallographic structure for the examples (1) to (3) and the comparative examples (1) and (2)

TABLE 2

| | Vf of first region A (%) | Vf of phases dispersed in first regions A (%) | | Vf of phases dispersed in grain boundary (%) | |
|---|---|---|---|---|---|
| | | β-phase | $\alpha_2$-phase | β-phase | $\alpha_2$-phase |
| Example (1) | 82 | 5 | 0 | 0 | 0 |
| Example (2) | 75 | 2 | 1 | 0 | 0 |
| Example (3) | 60 | 0.5 | 0 | 0 | 0 |
| Comparative example (1) | 0 | 0 | 0 | 3 | 7 |
| Comparative example (2) | 0 | 0 | 0 | 2 | 5 |

Figure 4A:
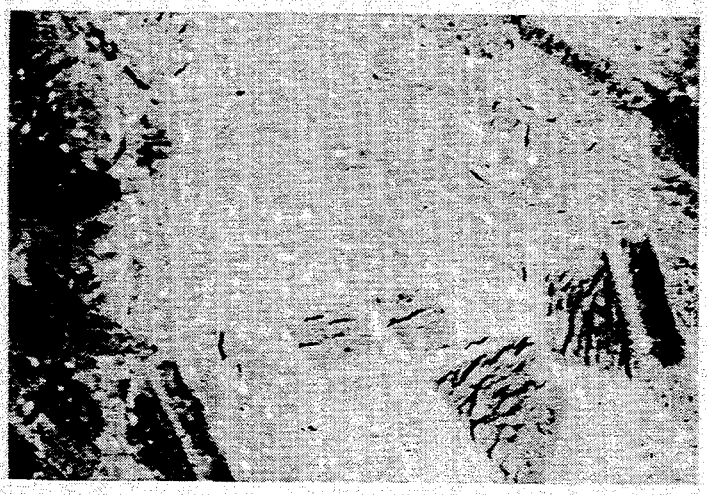
FIG. 4A is a photomicrograph showing a metallographic structure of a TiAl-based intermetallic compound according to an example of the present invention.
Figure 4B:
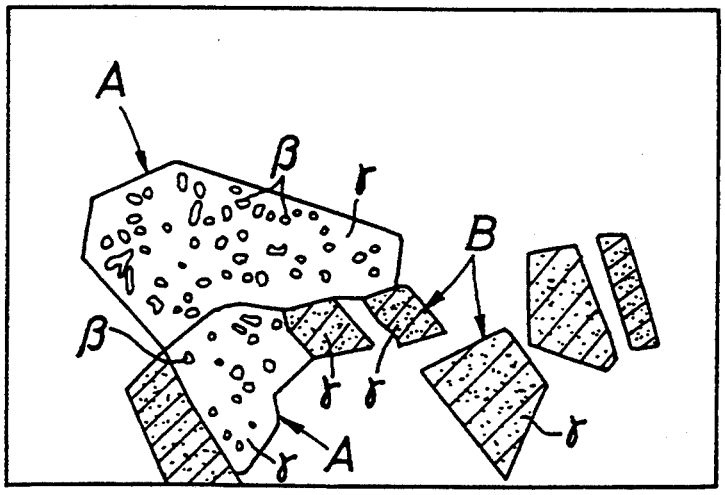
FIG. 4B is a schematic tracing of an essential portion shown in FIG. 4A.

FIG. 4A is a photomicrograph (2,000 magnifications) showing the metallographic structure of the example (1), and FIG. 4B is a schematic tracing of an essential portion shown in FIG. 4A. This metallographic structure corresponds to that shown in FIG. 2 and hence, has first regions A each having γ- and β-phases, and second regions B each having a γ-phase with no β-phase included therein.

Figure 5A:
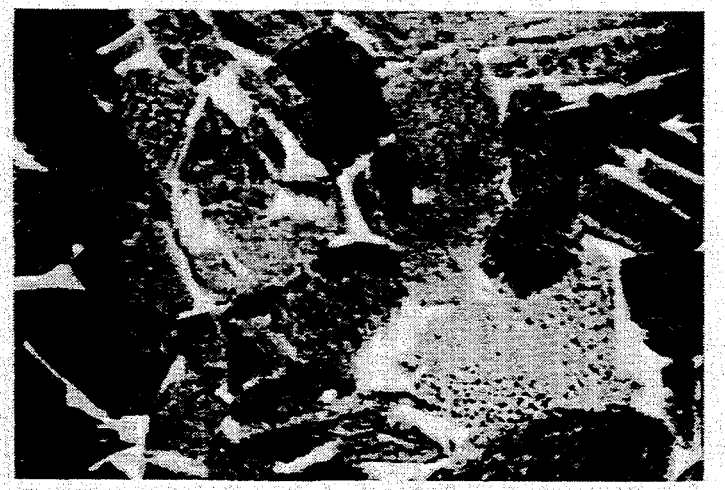
FIG. 5A is a photomicrograph showing a metallographic structure of a TiAl-based intermetallic compound according to a comparative example.
Figure 5B:
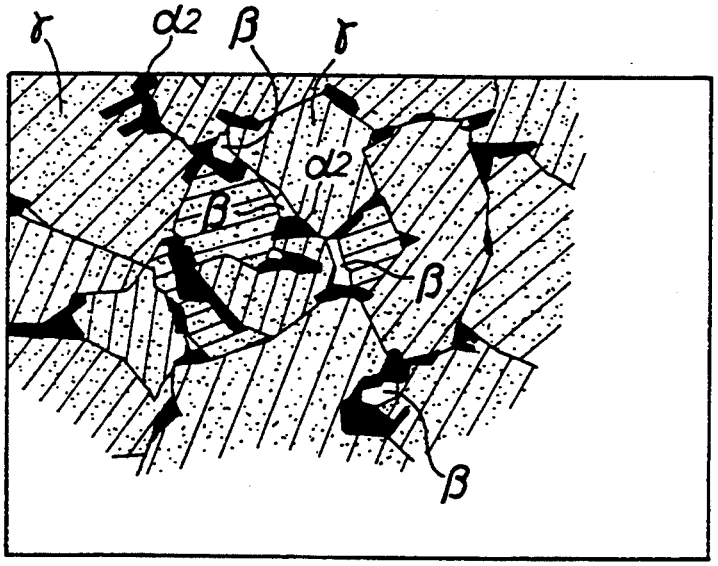
FIG. 5B is a schematic tracing of an essential portion shown in FIG. 5A.

FIG. 5A is a photomicrograph (2,000 magnifications) showing the metallographic structure of the comparative example (1), and FIG. 5B is a schematic tracing of an essential portion shown in FIG. 5A. In this metallographic structure, $\alpha_2$- and β-phases are precipitated at the grain boundary of each γ-phase, but no $\alpha_2$- and β-phases exist in the γ-phase.

Figure 6:
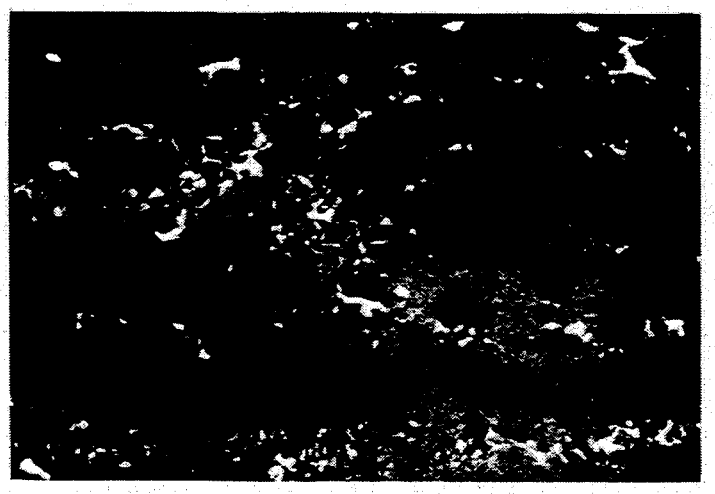
FIG. 6 is a photomicrograph showing a metallographic structure of a TiAl-based intermetallic compound blank.

FIG. 6 is a photomicrograph (500 magnifications) showing the metallographic structure of the comparative example (2). In FIG. 6, relatively white and small island-like portions are β-phases, more dark colored and smaller island-like portions are $\alpha_2$-phases, and the other portions are γ-phases. The β-phases and $\alpha_2$-phases are precipitated at the grain boundary of the γ-phases, but no $\alpha_2$- and β-phases exist in the γ-phase.

Figure 7:
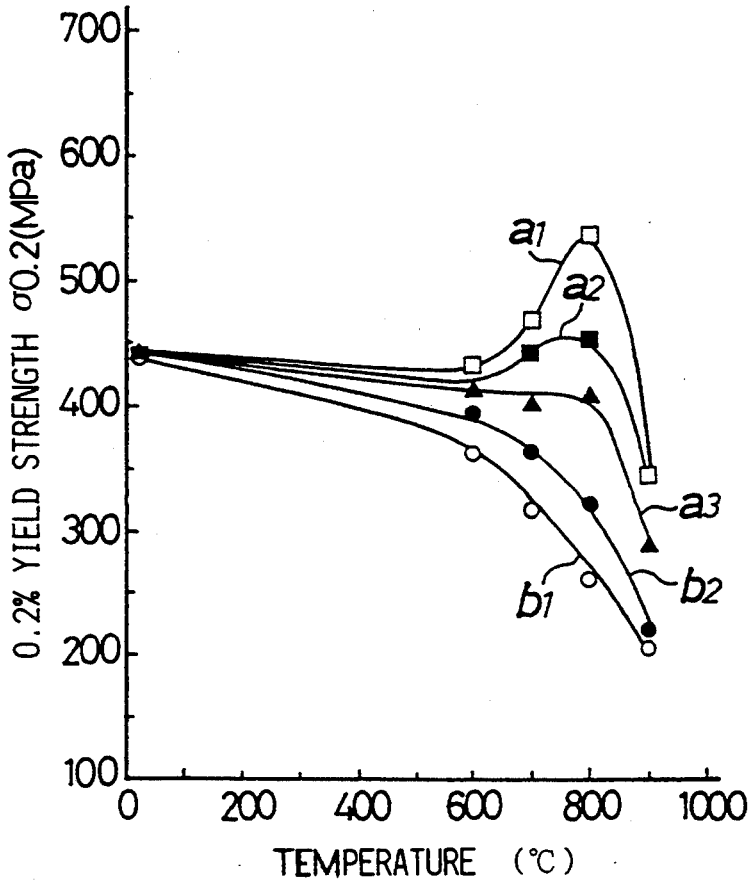
FIG. 7 is a graph illustrating the relationship between the temperature and the 0.2% yield strength.

FIG. 7 shows results of a tensile test in a range of from ambient temperature to 900° C. for the examples (1) to (3) and the comparative examples (1) and (2). In FIG. 7, a line $a_1$ corresponds to the example (1); a line $a_2$ to the example (2); a line $a_3$ to the example (3); a line $b_1$ to the comparative example (1), and a line $b_2$ to the comparative example (2).

It can be seen from FIG. 7 that the examples (1), (2) and (3) indicated by the lines $a_1$, $a_2$ and $a_3$ have an excellent high-temperature strength, as compared with the comparative examples (1) and (2) indicated by the lines $b_1$ and $b_2$. In the examples (1), (2) and (3), the high-temperature strength is increased with an increase in volume fraction Vf of the β-phases in the first region A. Especially in the case of the examples (1) and (2) indicated by the lines $a_1$ and $a_2$, the high-temperature strength is higher than the ambient-temperature strength at about 660° to about 880° C., and the maximum strength is shown at 800° C.

In the TiAl-based intermetallic compound of this type, the volume fraction Vf of β-phases is set equal to or more than 0.1% (Vf≧0.1%) in order to insure a high-temperature strength attributable to the presence of the β-phases.

Table 3 shows the conditions in the solution treatment, the volume fraction Vf of the first regions A, the volume fraction of the β-phases in the first regions A, and the elongation for examples (4) to (8) and a comparative example (3). The artificial aging treatment was carried out at 900° C. for 12 hours.

TABLE 3

| | Solution Treatment | | Vf of first region A (%) | Vf of β-phases in first region (%) | Elongation (%) |
|---|---|---|---|---|---|
| | Temperature (°C.) | Time (hour) | | | |
| Example (4) | 1250 | 2 | 39 | 4.5 | 1.3 |
| Example (5) | 1280 | 2 | 31 | 4.0 | 1.2 |
| Example (6) | 1300 | 2 | 15 | 2.0 | 1.0 |
| Example (7) | 1320 | 2 | 5 | 1.8 | 0.8 |
| Example (8) | 1340 | 2 | 2 | 0.2 | 0.25 |
| Comparative example (3) | 1400 | 2 | 0 | 0 | 0.2 |

Figure 8:
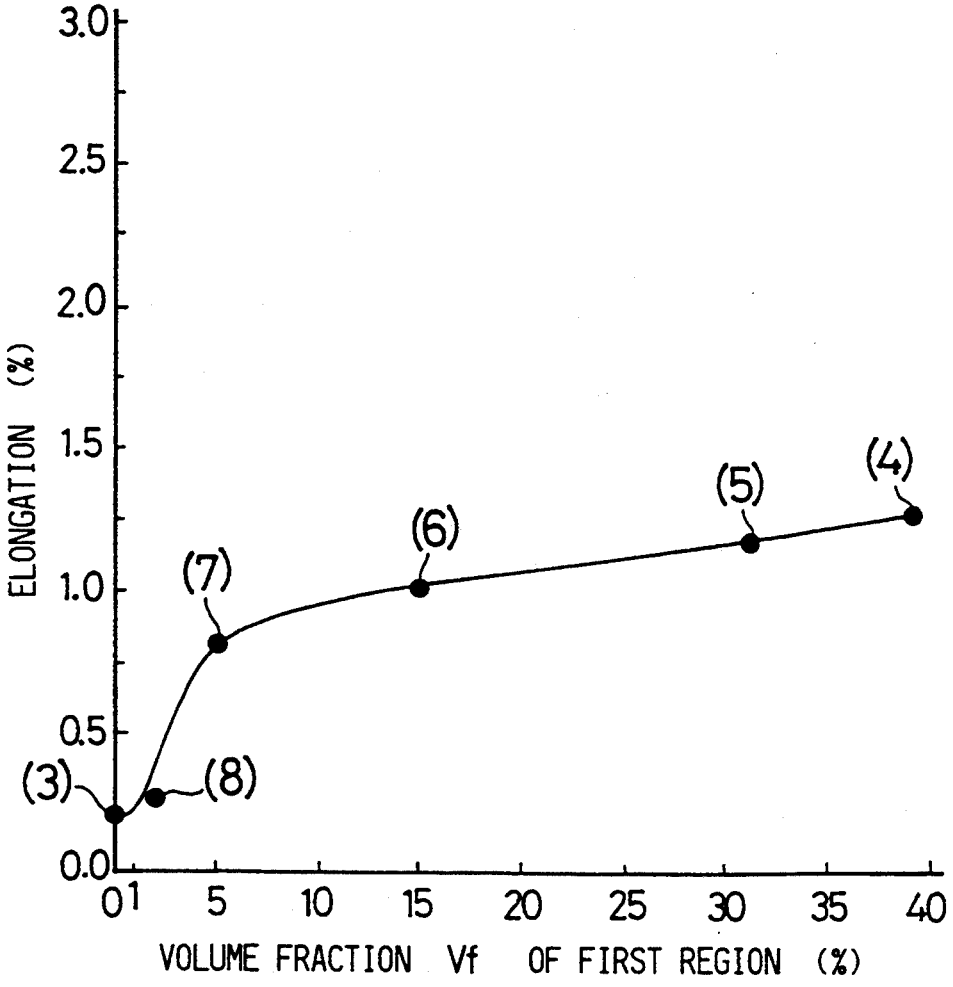
FIG. 8 is a graph illustrating the relationship between the volume fraction Vf of a first region and the elongation.

FIG. 8 is a graph taken from the relationship shown in Table 3, wherein spots (4) to (8) and (3) correspond to the examples (4) to (8) and the comparative example (3), respectively.

It is apparent from FIG. 8 that the elongation of the TiAl-based intermetallic compound has a point of inflection at about 1% the volume fraction Vf of the first regions A. Therefore, in order to insure a ductility of a TiAl intermetallic compound, the volume fraction of the first regions A is set equal to or more than 1% (Vf≧1%).

What is claimed is:

1. A TiAl-based intermetallic compound with an excellent high-temperature strength, wherein said compound has a metallographic structure which comprises a region having fine β-phases dispersed in a γ-phase, the volume fraction Vf of β-phases in said region being equal to or more than 0.1% (Vf≧0.1%).

2. A TiAl-based intermetallic compound with an excellent high-temperature strength according to claim 1, wherein $\alpha_2$-phases are dispersed in the γ-phase in said region.

3. A TiAl-based intermetallic compound with an excellent high-temperature strength according to claim 1, wherein the volume fraction (Vf) of said region in said metallographic structure is greater than or equal to 1%.

4. A TiAl-based intermetallic compound with an excellent high-temperature strength, wherein said compound has a metallographic structure which comprises a first region having fine β-phases dispersed in a γ-phase, and a second region having a γ-phase which does not include β-phase, the volume fraction Vf of the β-phases in said first region being equal to or more than 0.1% (Vf≧0.1%).

5. A TiAl-based intermetallic compound with an excellent high-temperature strength according to claim 4, wherein $\alpha_2$,phases are dispersed in the γ-phase in said first region.

6. A TiAl-based intermetallic compound with an excellent high-temperature structure according to claim 4, wherein the volume fraction (Vf) of said first region in said metallographic structure is greater than or equal to 1%.

7. A TiAl-based intermetallic compound with an excellent high-temperature strength according to claim 4 or 5, wherein the volume fraction Vf of said first region in said metallographic structure is equal to or more than 1% (Vf≧1%).

8. A TiAl-based intermetallic compound with an excellent high-temperature strength according to claim 1, 2, 4 or 5, further including at least one β-area enlarging element E selected from the group consisting of Mo, Nb, Ta, V, Co, Cr, Cu, Fe, Mn, Ni, Pb, Si and W, the content of said β-area enlarging element E being equal to or more than 0.5 atomic % (E≧0.5 atomic %).

* * * * *